US005352098A

United States Patent [19]

Hood

[11] Patent Number: 5,352,098

[45] Date of Patent: Oct. 4, 1994

[54] TURN VALVE CONTROL SYSTEM FOR A ROTARY SCREW COMPRESSOR

[75] Inventor: James A. Hood, Concord, N.C.

[73] Assignee: Ingersoll-Rand Company, Woodcliff Lake, N.J.

[21] Appl. No.: 51,725

[22] Filed: Apr. 22, 1993

[51] Int. Cl.[5] ..... F04B 49/00

[52] U.S. Cl. ..... 417/282; 417/295; 417/309; 418/201.2

[58] Field of Search ..... 417/309, 307, 295, 282; 418/201.2

[56] References Cited

U.S. PATENT DOCUMENTS

| | | | |
|---|---|---|---|
| 3,874,828 | 4/1975 | Herschler et al. . | |
| 3,961,862 | 6/1976 | Edstrom et al. | 417/282 |
| 4,052,135 | 10/1977 | Shoop et al. . | |
| 4,519,748 | 5/1985 | Murphy . | |
| 4,678,406 | 7/1987 | Pillis et al. | 418/201.1 |
| 5,054,995 | 10/1991 | Haseley et al. . | |
| 5,183,395 | 2/1993 | Langouet | 418/201.2 |

FOREIGN PATENT DOCUMENTS

| | | | |
|---|---|---|---|
| 2082798 | 3/1982 | United Kingdom | 417/309 |

*Primary Examiner*—Michael Koczo
*Assistant Examiner*—Michael I. Kocharov
*Attorney, Agent, or Firm*—Victor M. Genco, Jr.

[57] ABSTRACT

An apparatus for regulating the fluid throughput of a rotary screw compressor from a full capacity operating condition to a desired predetermined capacity operating condition includes a turn valve or spiral valve which is disposed in fluid communication with a low pressure fluid. A stepping motor positions the turn valve in a predetermined orientation. A position sensing means is operably connected to the turn valve. The position sensing means detects the angular orientation of the turn valve. A pressure sensing means detects a compressor service pressure. An electronic control means directs the stepping motor in a predetermined orientation. The electronic control means is independently operable to regulate the fluid throughput of the rotary screw compressor from a full capacity operating condition to a predetermined capacity operating condition in response to the first pressure sensing means.

6 Claims, 1 Drawing Sheet

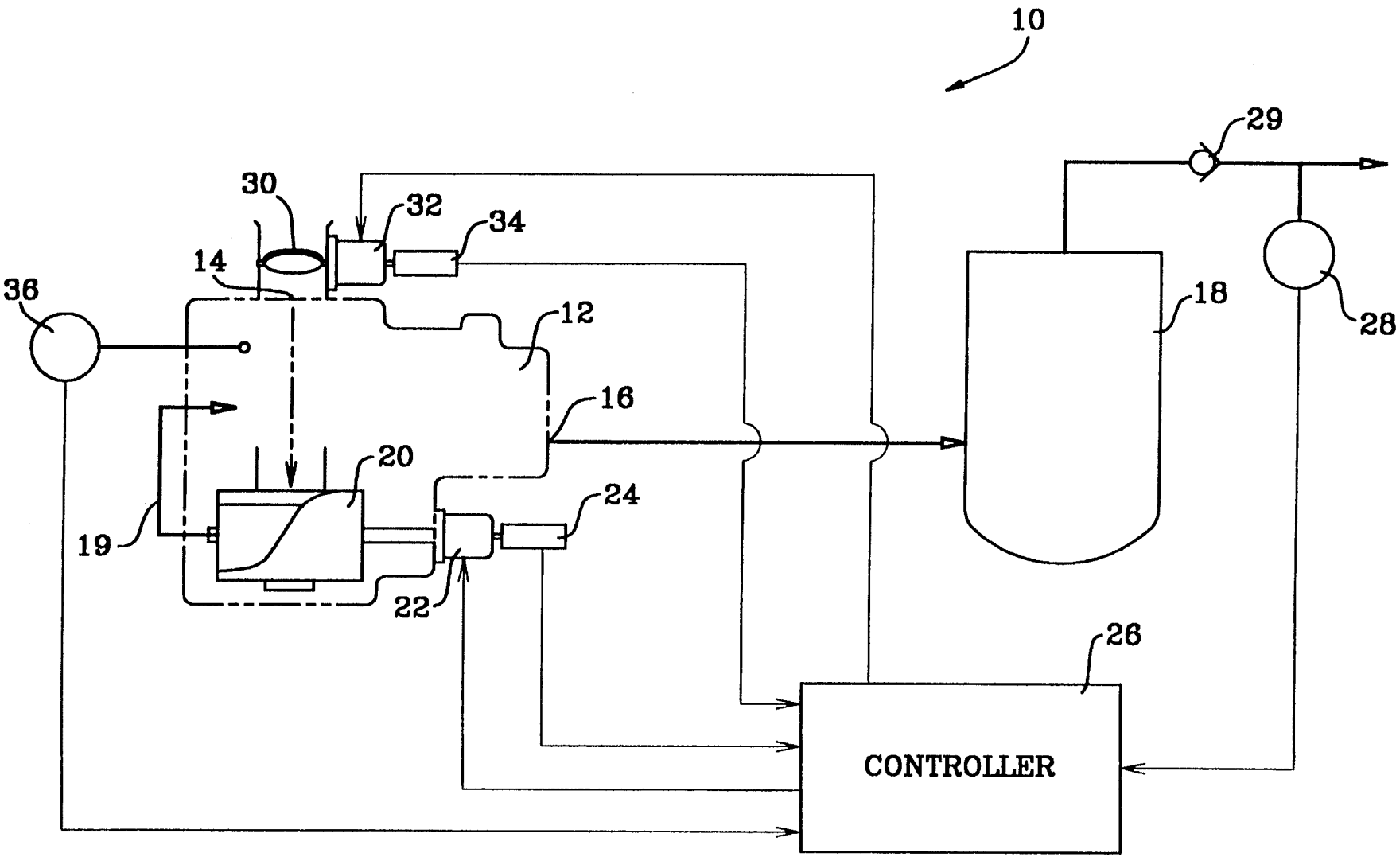
10
29
28
18
26
CONTROLLER
16
12
24
34
32
22
20
30
14
19
36

TURN VALVE CONTROL SYSTEM FOR A ROTARY SCREW COMPRESSOR

BACKGROUND OF THE INVENTION

This invention generally relates to compressor control systems, and more particularly to a capacity control system for a rotary screw compressor.

The application of helical screw compressors for supplying compressed air to pneumatic construction equipment and to industrial plant compressed air networks usually requires that the compressor be equipped with some form of compressor throughput or capacity control. A turn valve or spiral valve is a well known device for efficiently controlling capacity in a rotary screw compressor. Heretofore, turn valves typically have been controlled by such systems as a rack and pinion system having a piston at each end of the rack. Typically, these pistons are enclosed in a cylinder, and are controlled by a suitable actuating fluid, such as air or a hydraulic fluid, for example. In such a capacity control system, a control valve directs fluid pressure to a piston on a predetermined side of the rack to open or close the turn valve. However, while such compressor capacity control systems may be useful in their purpose, they are replete with a multiplicity of deficiencies and shortcomings which have detracted from their usefulness.

Foremost among the deficiencies attributable to such compressor control systems is their apparent inability to reach a steady state condition. Such compressor control systems must always be either opening or closing the turn valve. Additionally, such controls are typically prone to leaks of actuating fluid. Further, these controls may require cumbersome and complex actuating fluid lines. Finally, such compressor control systems are costly, and require careful calibration to function for their intended purposes.

The foregoing illustrates limitations known to exist in present capacity control systems for rotary screw compressors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid compressor regulating apparatus which includes a compressor having an inlet port for receiving a low pressure fluid to be compressed and a discharge port for discharging the compressed fluid at a predetermined pressure. A valve means is disposed in fluid communication with the low pressure fluid. A valve positioning means positions the valve means in a predetermined orientation in discrete, predetermined, angular steps. A position sensing means is operably connected to the valve means for detecting the angular orientation of the valve means. A pressure sensing means detects a service pressure of the fluid system. An electronic control means directs the valve positioning means in a predetermined orientation to regulate compressor capacity in response to the pressure sensing means.

The foregoing and other aspects will become apparent from the following detailed description of the invention when considered in conjunction with the accompanying drawing figures.

BRIEF DESCRIPTION OF THE DRAWING FIGURES

The only FIGURE is a schematic representation of an apparatus for regulating capacity in a fluid system according to the present invention.

DETAILED DESCRIPTION

Referring now to the FIGURE, illustrated generally at 10 is a schematic representation of an apparatus for regulating the fluid throughput of a rotary screw compressor from a full capacity operating condition to a predetermined capacity operating condition according to the present invention. In the preferred embodiment, the apparatus 10 is adapted for use in combination with a rotary screw compressor 12.

The rotary screw compressor 12 has a compressor inlet port 14 for receiving a low pressure fluid to be compressed, such as air for example. The compressor 12 also has a discharge port 16 for discharging the compressed air at a predetermined pressure. The compressed air discharged by the compressor 12 is directed to a compressed air system which contains such common system elements as an oil/air separator receiver 18, and a service valve (not shown), for example. The compressed air which is supplied to the service valve may be used to provide motive force to a variety of pneumatic implements, such as pneumatic hand tools, for example.

Incorporated within the compressor 12, and illustrated schematically in the FIGURE, is a bypass means 19 which is made integral with the compressor 12, and which is operable to remove a predetermined volume of low pressure air from the compression cycle, as is well known in the art. A rotatable valve 20, such as a turn valve or a spiral valve, is disposed in fluid communication with the bypass means 19 to control the volume of low pressure fluid which is removed from the compression process and which is routed through the bypass means.

A turn valve positioning means 22, such as a first stepping motor for example, is operably connected to the turn valve 20 for positioning the turn valve in a predetermined orientation. The stepping motor 22 positions the turn valve in discrete, predetermined, angular steps which permits the compressor to operate in a steady state condition, as will be described in further detail hereinafter. A first position sensing means 24, such as proximity switch or a position encoder for example, is operably connected to the turn valve 20 for detecting the angular orientation of the turn valve. The first position sensing means 24 inputs the turn valve position information to an electronic control means or controller 26 for processing. The electronic control means is described in further detail hereinafter.

A first pressure sensing means 28 is flow connected in the compressed fluid system in a predetermined location between a check valve 29 and the service valve. The first pressure sensing means is operable to detect the service pressure of the compressed fluid system. The detected service pressure is provided to the electronic control means 26 for processing. As should be understood, the rotary screw compressor 12 is designed such that the low pressure fluid may be directed along one of two routes. The low pressure fluid either may be permitted to enter the compression cycle to be discharged through the compressor outlet in the form of a usable compressed fluid, or the low pressure fluid may be directed away from the compression cycle, by way of the bypass means 19. In this regard, the turn valve 20 controls and directs the low pressure fluid through one of these two routes. The sum of the total volume of low pressure fluid to be compressed must enter either the bypass means 19 or be compressed by action of the compressor 12. Therefore, as the turn valve varies the amount of low pressure fluid to bypass the compression cycle, the volume of fluid discharged is altered in equal but opposite amounts.

As illustrated in the FIGURE, an inlet port control system may be utilized in addition to the turn valve 20 to regulate the fluid throughput of the rotary screw compressor 12 from a full capacity operating condition to a predetermined capacity operating condition. In this regard, an inlet port valve 30, such as a butterfly valve, is flow connected with the inlet port 14 for regulating the volume of low pressure fluid to be compressed. An inlet port valve positioning means 32, such as a second stepping motor, positions the inlet port valve 30 in a predetermined orientation, in discrete, predetermined, angular steps. A second position sensing means 34 is operably connected to the inlet port valve 30 for detecting the angular orientation of the inlet port valve. A second pressure sensing means 36 is operable for detecting fluid pressure at the compressor inlet port.

In the preferred embodiment, the electronic control means 26 is a microprocessor based controller such as that disclosed in U.S. Pat. No. 5,054,995, which is incorporated herein by specific reference. As can be seen by reference to the FIGURE, the controller 26 is disposed in signal transmitting relation to the first stepping motor 22 and the second stepping motor 32. Additionally, the controller is disposed in signal receiving relation to the first position sensing means 24, the first pressure sensing means 28, the second position sensing means 34, and the second pressure sensing means 36. The electronic control means 26 is independently operable to regulate the fluid throughput of the rotary screw compressor 12 from a full capacity operating condition to a predetermined capacity operating condition in response to the first and second pressure sensing means. Although the preferred embodiment of the present invention incorporates an electronically controlled inlet port valve 30 as an element in a rotary screw compressor capacity control system, it should be understood that the throughput of the rotary screw compressor 12 may be adequately regulated solely by utilizing the turn valve 20 in combination with the first stepping motor 22, the first position sensing means 24, the first pressure sensing means 28, and the electronic control means 26.

In operation, a predetermined reference pressure is established and inputted into the controller. Thereafter, and during compressor operation, the controller 26 receives input from the first and second pressure sensors 28, 36, and the first and second position sensors 24, 34. The electronic control means 26 processes the pressure inputs and the position inputs. The pressure input from the first pressure sensing means is compared with the predetermined reference pressure. Thereafter, a signal consisting of direction and number of steps is transmitted by the controller to the first and second stepping motors, respectively, to thereby regulate the fluid throughput of the rotary screw compressor from a predetermined existing capacity operating condition to a desired predetermined operating condition.

The electronic control means 26 is responsive to the first and second position sensing means such that the control means does not provide signals to the first and second stepping motors to cause the turn valve or the inlet port valve to be over rotated. For example, the control means does not provide a signal indicating the further opening of the turn valve in order to decrease the fluid pressure in the compressed fluid system if the position sensing means indicates that the turn valve is completely open. Likewise, the control means does not produce a signal causing the turn valve to be further closed if the position sensing means indicates that the turn valve is completely closed.

The electronic control means also preferably includes a means for regulating the turn valve and the inlet port valve for maintaining compressor steady-state operation. In steady-state compressor operation, the turn valve and the inlet port valve are maintained in predetermined positions to permit a constant fluid throughput. Therefore, the turn valve and the inlet port valve are maintained in the predetermined steady-state position when the fluid pressure of the compressed fluid system, as detected by the first pressure sensing means, is equal to or substantially equal to the reference pressure.

As may be appreciated by one skilled in the art, the apparatus 10 is an advancement in the art, and advantageous in its use because the apparatus 10 permits the compressor 12 to achieve and maintain steady-state operation, the apparatus 10 eliminates cumbersome and complex actuating fluid lines, and the apparatus 10 requires virtually no calibration to function for its intended purposes.

While this invention has been illustrated and described in accordance with a preferred embodiment, it is recognized that variations and changes may be made therein without departing from the invention as set forth in the following claims.

Having described the invention, what is claimed is:

1. In a rotary screw compressor having an inlet port for receiving a low pressure fluid to be compressed and a discharge port for discharging the compressed fluid at a predetermined pressure, an apparatus for regulating the fluid throughput of the rotary screw compressor from a full capacity operating condition to a desired, predetermined capacity operating condition, the apparatus comprising:

an inlet valve flow connected with the inlet port;

positioning means for positioning the inlet valve in a predetermined orientation, the inlet valve positioning means positioning the inlet valve in discrete, predetermined, angular steps;

position sensing means, operably connected to the inlet valve, for detecting the angular orientation of the inlet valve;

pressure sensing means for detecting fluid pressure at the compressor inlet port;

a rotatable valve disposed in fluid communication with the low pressure fluid;

rotatable valve positioning means for positioning the rotatable valve in a predetermined orientation, the rotatable valve positioning means positioning the rotatable valve in discrete, predetermined, angular steps;

position sensing means, operably connected to the rotatable valve, for detecting the angular orientation of the rotatable valve;

pressure sensing means for detecting a compressor service pressure; and electronic control means, responsive to the inlet valve and rotatable valve position sensing means and to the inlet port pressure and service pressure sensing means, for controlling the inlet valve positioning means and the rotatable valve positioning means to orient the inlet valve and the rotatable valve in a respective, predetermined position thereby regulating a fluid throughput of the rotary screw compressor from a full capacity to a predetermined capacity during compressor operation.

2. The apparatus according to claim 1, and wherein the rotatable valve positioning means is a stepping motor.

3. The apparatus according to claim 1, and wherein the electronic control means is operable to hold the rotatable valve in a predetermined orientation to permit steady-state compressor operation.

4. The apparatus according to claim 1, and wherein the inlet valve positioning means is a stepping motor.

5. The apparatus according to claim 1, and wherein the electronic control means is operable to hold the inlet valve in a predetermined orientation to permit steady-state compressor operation.

6. The apparatus according to claim 1, and wherein the electronic control means is a microprocessor.

* * * * *